United States Patent [19]

McMahon et al.

[11] Patent Number: 4,660,716

[45] Date of Patent: Apr. 28, 1987

[54] PACKAGING ARRANGEMENT FOR PREPARING AND SERVING FOOD PRODUCTS

[75] Inventors: Michael J. McMahon, Palatine; Leonard E. Johnson, Buffalo Grove, both of Ill.

[73] Assignee: Signode Corporation, Glenview, Ill.

[21] Appl. No.: 780,424

[22] Filed: Sep. 26, 1985

[51] Int. Cl.[4] ..... B65D 25/04

[52] U.S. Cl. ..... 206/216; 206/541; 206/546; 220/22; 220/23.8; 220/23.83

[58] Field of Search ..... 206/545, 546, 549, 550, 206/216, 541; 220/22, 23.8, 23.83

[56] References Cited

U.S. PATENT DOCUMENTS

| | | | |
|---|---|---|---|
| 3,016,129 | 1/1962 | King, III | 206/545 |
| 3,107,027 | 10/1963 | Hong | 220/23.8 |
| 3,342,397 | 9/1967 | Duitsman . | |
| 3,532,247 | 10/1970 | Bridges | 206/545 |
| 3,595,425 | 7/1971 | Eicholtz | 220/367 |
| 3,938,688 | 2/1976 | Ryan | 206/545 |
| 4,081,646 | 3/1978 | Goltos | 219/10.55 |
| 4,545,487 | 10/1985 | Asmus | 206/545 |

FOREIGN PATENT DOCUMENTS

| | | | |
|---|---|---|---|
| 0651282 | 10/1962 | Canada | 220/23.8 |
| 1315114 | 12/1962 | France | 220/23.8 |

OTHER PUBLICATIONS

"Plastics in Packaging–PET Trays Heat Up Frozen Foods"; *Plastics World;* Feb., 1985; pp. 30–33.

"Plastics in Packaging–Thermoformer Builders Tool Up for CPET Action"; *Plastics World;* Feb., 1985; pp. 37–41.

"Dual-Ovenable Trays in the U.S. Market: A Business Review"; Leslie A. Mion; First International Conference on New Innovations in Packaging Technologies and Market, Nov., 1983.

*Primary Examiner*—George E. Lowrance
*Assistant Examiner*—Jimmy G. Foster
*Attorney, Agent, or Firm*—Dressler, Goldsmith, Shore, Sutker & Milnamow, Ltd.

[57] ABSTRACT

A packaging arrangement for preparing and serving food products is disclosed which facilitates packaging, preparation, and serving of two or more food products in the arrangement. The construction includes a unitary, one-piece partitioned tray which defines a plurality of cavities for respectively receiving the different food products. The construction further includes a combination covering and serving member configured for releasable securement to the partitioned tray, and which is configured to resemble conventional dinnerware. The covering and serving member initially functions as a cover for the partitioned tray. However, upon inversion of the entire arrangement the food products transfer from the cavities of the tray onto the covering and serving member for serving and consumption of the food products, with the tray and serving member cooperating to prevent substantial commingling of the adjacent food products.

7 Claims, 7 Drawing Figures

PACKAGING ARRANGEMENT FOR PREPARING AND SERVING FOOD PRODUCTS

TECHNICAL FIELD

The present invention relates generally to compartmentalized packaging constructions for food products, and more particularly to a packaging arrangement for heating and serving food products comprising a partitioned tray having a plurality of food-receiving cavities, and a combination covering and serving member which cooperates with the tray such that the packaging arrangement can be inverted and the food products transferred from the tray onto the covering and serving member for heating and serving.

BACKGROUND OF THE INVENTION

Various packaging arrangements for food products are known which facilitate preparation of the food products for consumption. For example, some packaging arrangements comprise a lower pan-like member which holds a food product, with a removable cover releasably fitted to the lower member such as by crimping or the like. This type of package generally permits heating of the food product in a conventional or microwave oven (depending upon the material from which the package is formed), with the food product typically removed from the pan-like member for serving on a dinner plate or the like.

Other types of packaging arrangements are known which are configured for holding a plurality of different food products in individual compartments. For example, packaging arrangements for so-called "frozen dinners" typically include a suitably shaped metallic foil tray which defines a plurality of compartments for respectively holding different food products. A metallic foil sheet is typically fitted to the top of this type of tray after food products have been placed therein, whereby the food products can be prepared by placing the entire construction in an oven. After heating, the foil sheet is removed for consumption of the food products from the compartmentalized tray.

While the above-described compartmentalized packaging construction has been in widespread use for a number of years, many people find it unappealing to consume the food products from the construction's compartmentalized tray portion since it bears little resemblance to conventional dinnerware on which foods are usually served. Additionally, this type of packaging arrangement can detract from the appeal of the premium quality or "gourmet" foods which have become increasingly popular with consumers.

It is therefore desirable to provide a packaging arrangement suitable for holding a plurality of different food products (for example, an entree, and one or more side dishes) which facilitates packaging of the products, which segregates the products during shipment and storage, which permits heating in either a conventional or microwave oven, and which presents the products for consumption on a dinnerware-like serving member for enhanced consumer appeal.

SUMMARY OF THE INVENTION

A packaging arrangement embodying the features of the present invention has been particularly configured for packaging together economically a plurality of different food products. The packaging materials preferably are selected to permit heating of the products in a conventional and/or microwave oven. In order to enhance the appearance and appeal of the food products when served, the packaging arrangement includes a dinnerware-like combination covering and serving member which is fitted to a multi-cavity partitioned tray. By this construction, the covering and serving member cooperates with the partitioned tray to retain the different food products on the tray in their respective cavities defined by the tray. The packaging arrangement is invertible prior to the consumption of the products, whereby the food is transferred onto the non-partitioned, dinnerware-like covering and serving member for heating and ultimate consumption.

The partitioned tray of the present packaging arrangement includes a substantially planar base means comprising a plurality of base panels respectively defining the lower extent of each cavity or compartment defined by the tray. The partitioned tray further includes an upstanding, segmented sidewall construction including two or more sidewall portions which extend integrally upwardly from the base panels. The sidewall portions collectively define a continuous peripheral edge portion of the tray.

The partitioned tray further includes at least one upstanding partition member which extends integrally upwardly from the base panels of the tray. In the preferred embodiment, each partition member comprises a pair of adjacent partition walls having their upper portions merging into each other, and their lower portions respectively merged into the base panels of adjacent ones of the tray's food cavities. As will be appreciated, the above-described construction for the partitioned tray facilitates economical manufacture from suitable sheet material, such as "ovenable" paperboard, moldable plastic sheet, metallic foil, or the like.

The combination covering and serving member of the present packaging arrangement resembles a piece of conventional dinnerware for enhanced consumer appeal. The covering and serving member includes a substantially planar central portion, and an integral annular rim portion that extends away from the central portion. When the covering and serving member functions as a cover for the partitioned tray, the annular rim portion depends downwardly from the central portion.

The present packaging arrangement further includes means for releasably securing the covering and serving member in a generally superposed relation to the partitioned tray. In the illustrated embodiments, the releasable securement means comprises recess means defined by one of the partitioned tray and the covering and serving member for releasably receiving lip means defined by the other of the tray and the covering and serving member. As will be recognized, the securement means are preferably integrally formed with the partitioned tray and the covering and serving member such as by configuring the peripheral edge portion of the tray or serving member for releasable positioning in cooperation with one or more recesses defined by the other of the tray and serving member.

In the preferred form, each partition member of the partitioned tray extends upwardly from the base panels beyond the sidewall portions of the tray such that each partition member extends at least partially into the covering and serving member when it is secured to the partitioned tray. The upper extent of each partition member is preferably provided with a configuration which is generally complemental to the interior configuration of the covering and serving member so that the partition members abut or are closely spaced to the interior of the serving member. By this arrangement, each partition member cooperates with the covering and serving member for retaining the food products in the respective ones of the cavities defined by the partitioned tray during shipment and storage.

To enhance the versatility of the present packaging arrangement, and to promote convenient use by consumers, it is presently preferred that the covering and serving member of the arrangement comprise so-called "dual ovenable" material. Such materials exhibit sufficient temperature resistance to permit use in a conventional oven, while also exhibiting sufficient transparency to microwave energy to permit use in microwave ovens. Additionally, such materials can be formulated for good low-temperature strength thus permitting their use for packaging of frozen food products which are subsequently prepared in either a conventional or microwave oven.

The partitioned tray of the present arrangement is preferably formed from relatively less expensive sheet material that can, but need not, withstand elevated temperatures, depending upon the intended method of preparing the food products. Such materials can include "ovenable" paperboard, moldable plastic sheet, metallic foil, and the like. After the packaging arrangement is turned over so that the food products move on to the covering and serving member, the partitioned tray may be left in place or removed, depending upon the nature of the food products, the material from which the tray is formed, and the desired method of heating.

Numerous other advantages and features of the present invention will become readily apparent from the following detailed description of the invention and the embodiments thereof, from the claims, and from the accompanying drawings.

DETAILED DESCRIPTION

Figure 1:
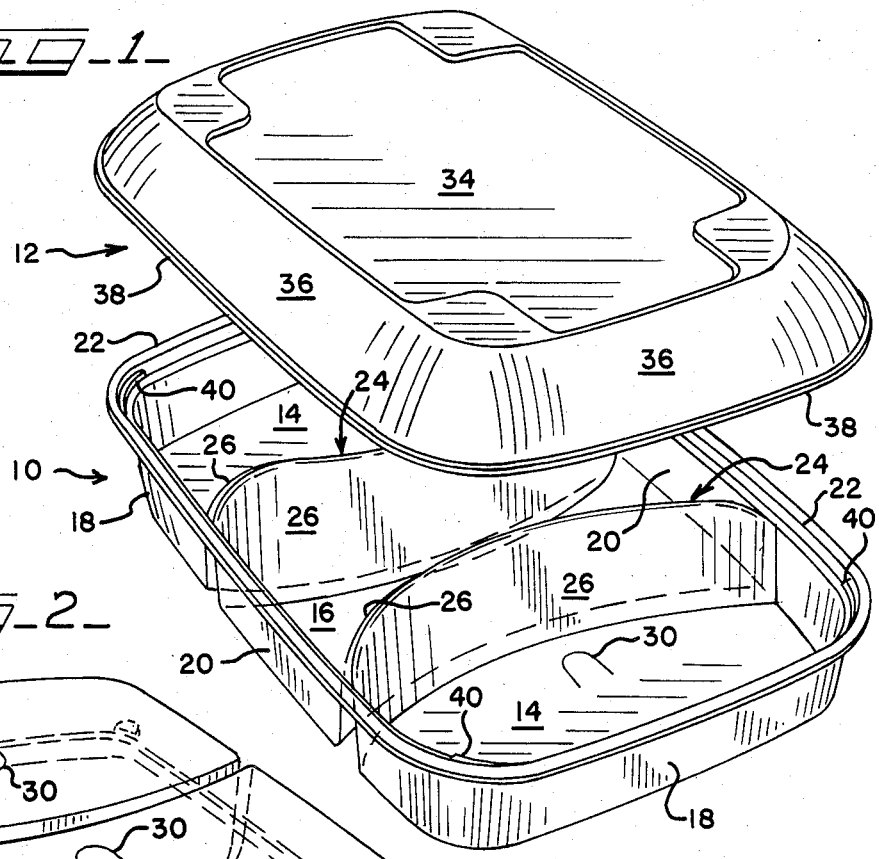
FIG. 1 is a perspective view of a packaging arrangement embodying the principles of the present invention which illustrates a partitioned tray of the arrangement ready for disposition of food products therein, and a combination covering and serving member of the arrangement shown in spaced relation to the tray but adapted for securement thereto.
Figure 2:
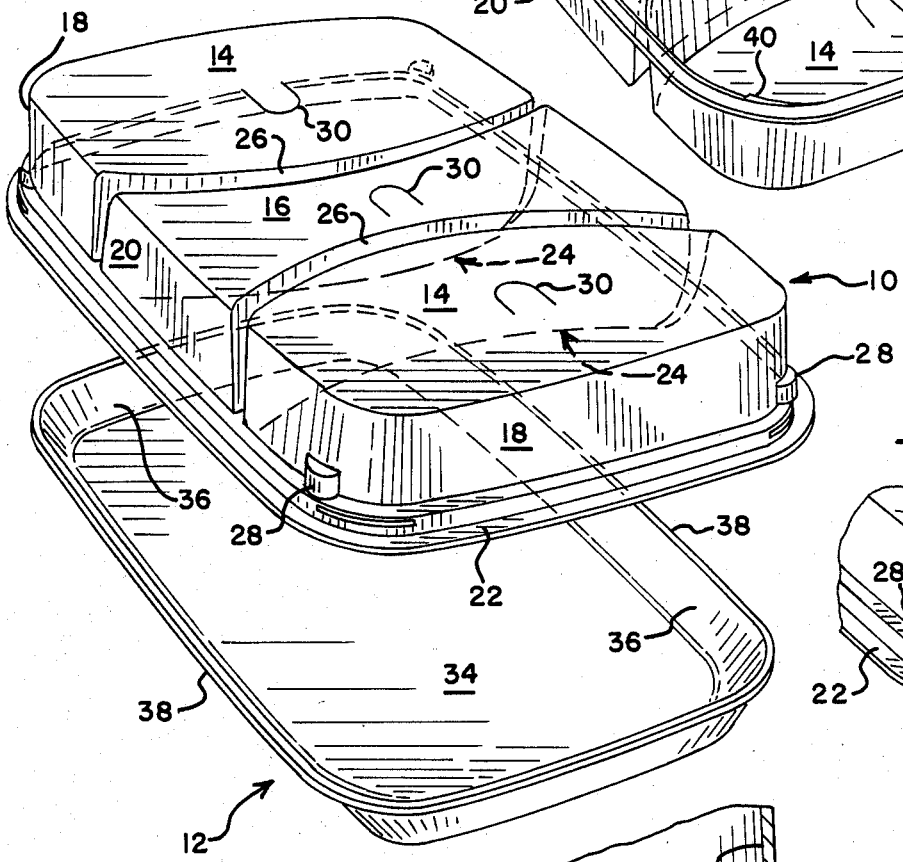
FIG. 2 is a further perspective view of the packaging arrangement shown in FIG. 1, wherein the arrangement has been inverted and the partitioned tray removed from the covering and serving member.
Figure 3:
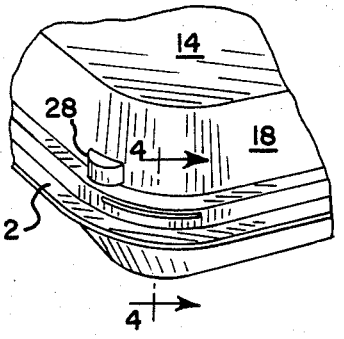
FIG. 3 is a fragmentary perspective view of a corner portion of the present packaging arrangement illustrating the partitioned tray and the covering and serving member secured together.

While the present invention is susceptible of embodiment in various forms, there are shown in the drawings and will hereinafter be described first and second embodiments thereof, with the understanding that the present disclosure is to be considered as an exemplification of the invention, and is not intended to limit the invention to the specific embodiments illustrated.

With reference first to FIGS. 1–4, illustrated is a packaging arrangement for preparing and serving food products embodying the features of the present invention. As will be further described in detail, the present arrangement comprises a partitioned or compartmentalized tray 10 defining a plurality of cavities or compartments for respectively holding different food products, and a combination covering and serving member 12 which is configured for releasable securement to the partitioned tray 10. For purposes of clarity, terms of orientation such as "upstanding", "depending", and the like will refer to the orientation of the packaging arrangement as shown in FIG. 1.

Figure 4:
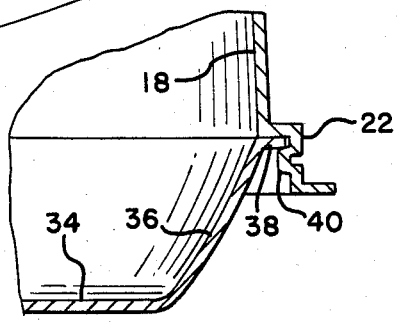
FIG. 4 is a view partially in section taken along the plane 4—4 of FIG. 3.

The configuration of partitioned tray 10 will first be described. In the illustrated embodiment, the tray 10 is of a one-piece, generally rectangular configuration, and is shown as defining three separate cavities or compartments for respectively receiving different food products. The substantially planar base of the tray 10 is collectively provided by a plurality of substantially planar base panels, which in the illustrated embodiment include a pair of outer base panels 14 and a central or inner base panel 16. The base panels are substantially bounded by an upstanding, segmented sidewall construction comprising longitudinally opposite end sidewall portions 18 and a pair of transversely opposed intermediate sidewall portions 20. The sidewall portions 16 and 18 extend upwardly from the base panels 14 and 16, respectively and are integral therewith. The sidewall portions collectively terminate in a continuous annular peripheral edge or flange 22. As best shown in FIG. 4, peripheral edge 22 is preferably of a stepped or L-shaped configuration for cooperation with covering and serving member 12, as will be further described.

The partitioned tray 10 further includes at least one upstanding partition member 24 extending integrally from the base panels of the tray. In the illustrated embodiment, tray 10 is provided with two partition members 24, with the tray thus defining the three cavities such as for receiving three different food products, respectively, therein.

In the preferred form, each partition member 24 comprises a pair of adjacent and substantially parallel partition walls 26. The partition walls 26, of each partition member 24 are integrally joined to each other along their upper edges, with the lower edges of the walls 26 respectively integrally joined to the base panels 14 and 16 of adjacent ones of the cavities defined by tray 10. In order to segregate the food products held within different ones of the cavities, the partition walls 26 of each partition member are further integrally joined to the sidewall portions of the tray 10. Thus, in the illustrated embodiment, the inner confronting ones of the partition walls 26 of the two partition members 24 extend between and are integrally joined to transversely opposed sidewall portions 20. The other partition wall 26 of each partition member 24 is respectively joined to one of the end sidewall portions 18.

As will be recognized, the number of cavities defined by tray 10, and the relative size of the cavities, can be widely varied in keeping with the principles disclosed herein. While the three cavities of the illustrated partitioned tray 10 are of generally similar size, it will be recognized that a packaging arrangement embodying the present invention may include two or more equally sized cavities, one small cavity and one relatively large cavity, two relatively small cavities and one relatively large cavity, etc. Similarly, the partitioned tray can be formed in many different configurations besides the generally rectangular form shown, such as circular, oval, etc. However, it is important to note that the above-described configuration of tray 10 is such that very economical manufacture of the tray from suitable sheet material can be effected.

Other features of the illustrated embodiment of partitioned tray 10 facilitate efficient packaging and convenient food product preparation. If desired, tray 10 may be provided with integrally formed destacking projections 28 (illustrated as being provided generally at each corner of the generally rectangular tray 10) which prevent a stacked plurality of the trays from becoming substantially completely nested within each other. The provision of destacking projections such as 28 acts to avoid surface-to-surface contact between the base panels of adjacently stacked trays, which such surface-to-surface contact can undesirably inhibit mechanical destacking of the trays such as by suction means or the like during product packaging.

If desired, partitioned tray 10 may further be provided with means for selectively venting the cavities defined thereby. In the illustrated embodiment, each of the base panels 14 and 16 defines a preferentially weakened, imperforate, U-shaped vent score 30 which can be selectively opened, thus providing venting of the cavity during heating of the food when the partitioned tray serves as the "cover" for the covering and serving member 12.

The configuration of the combination covering and serving member 12 will now be described. As will be apparent from the drawings, this portion of the present packaging arrangement is configured for efficient and economical manufacture while providing an appearance resembling that of conventional dinnerware. In the preferred form, covering and serving member 12 corresponds in shape and dimension to the partitioned tray 10, and thus is shown as having a generally rectangular configuration in the illustrated embodiment. The member 12 includes a substantially planar central portion 34, and an integral depending annular rim portion 36 surrounding the central portion. As will be evident from FIG. 2, the "dished" configuration of covering and serving member 12 facilitates convenient consumption of food products packaged in the present arrangement.

The present packaging arrangement is preferably provided with means for releasably securing the partitioned tray 10 and the covering and serving member 12 to each other in substantially superposed relation. To this end, the annular rim portion 36 of member 12 terminates in a bead-like peripheral edge 38. Releasable securement of tray 10 and covering and serving member 12 together is further effected by the provision of means defining one or more recesses in the partitioned tray 10 spaced inwardly from the peripheral edge thereof. In the illustrated embodiment, such recess means are provided by recess-defining projections 40 which extend integrally inwardly from annular peripheral edge 22 of partitioned tray 10 generally at each of the four corners thereof. As best illustrated in FIG. 4, the peripheral edge 38 of covering and serving member 12 functions as a lip which is releasably received within the recess defined by each of the projections 40. The resilient flexibility of the materials from which tray 10 and covering and serving member 12 are preferably formed accommodates releasable securement of the tray 10 and member 12 together in this manner.

Figure 5:
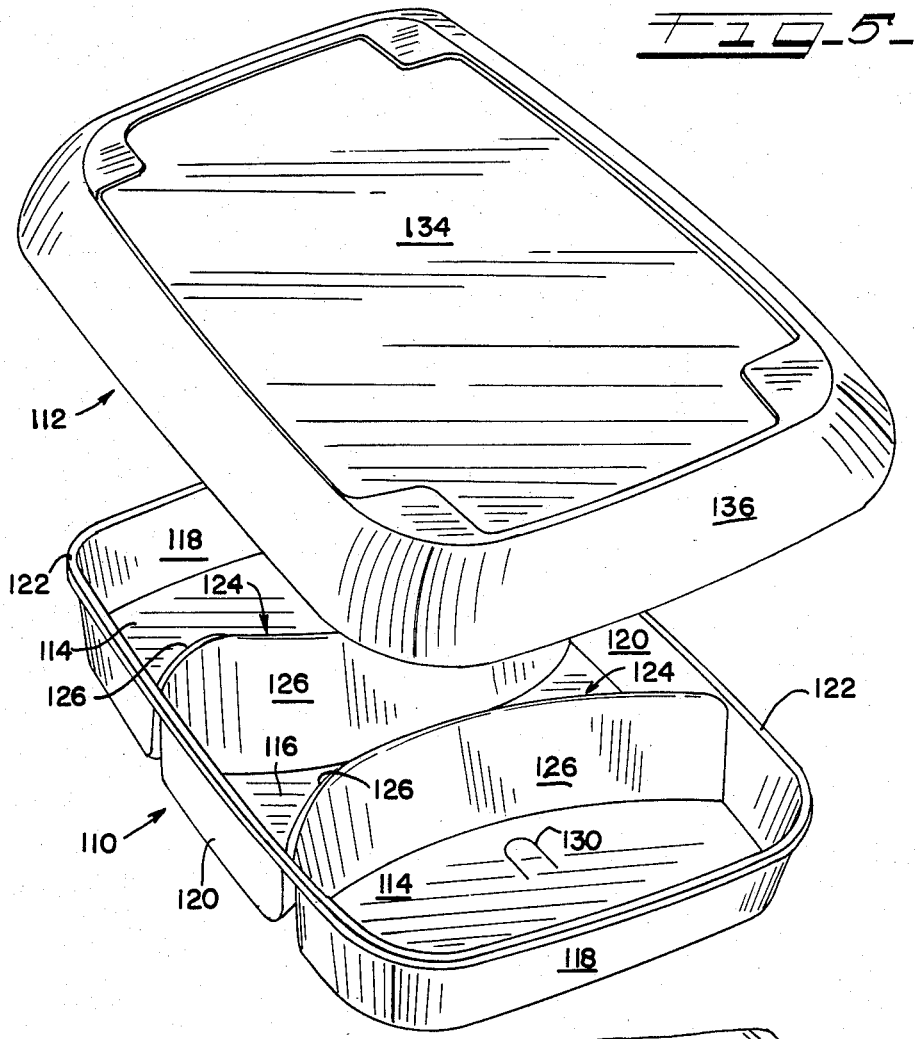
FIG. 5 is a perspective view similar to FIG. 1 illustrating a further embodiment of the present packaging arrangement including a partitioned tray and a cooperating covering and serving member.
Figure 6:
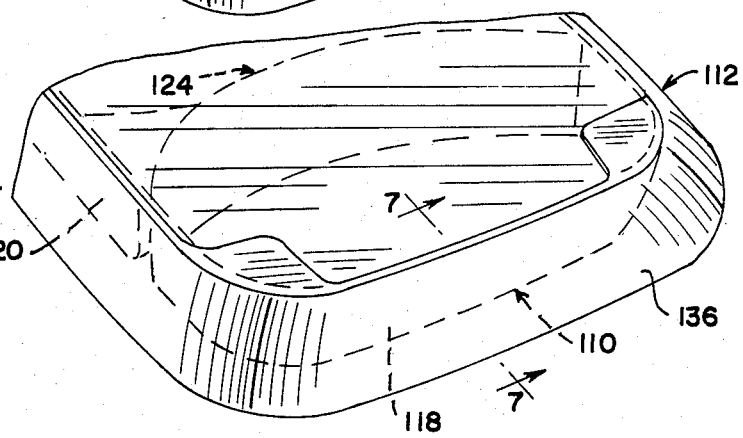
FIG. 6 is a partial perspective view showing the partitioned tray and covering and serving member of the embodiment of FIG. 5 secured together.
Figure 7:
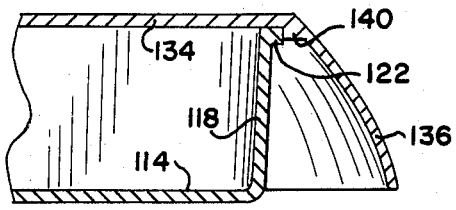
FIG. 7 is a view partially in section taken along the plane 7—7 of FIG. 6.

FIGS. 5–7, illustrate an alternate embodiment of the present packaging arrangement that provides a reduced stacking height as an additional feature. This embodiment of the arrangement in many respects is similar to the previously described embodiment, and accordingly, reference numerals in the one-hundred series but having like second and third digits identify elements that correspond in function to those in the previously described embodiment.

In this alternate embodiment, a partitioned tray 110 comprises a plurality of substantially planar base panels 114 and 116, and a segmented sidewall construction comprising integral end sidewalls 118 and intermediate sidewalls 120 which extend upwardly from the base panels. In distinction from the previous embodiment, however, the sidewalls 118 and 120 collectively terminate in an annular edge or flange 122 of a substantially bead-like configuration.

Tray 110 is illustrated as including a pair of upstanding partition members 124, each comprising a pair of partition walls 126 joined to each other at their upper edges, and respectively joined to the base panels of the adjacent ones of the three food-receiving cavities defined by the tray 110. U-shaped vent scores 130 can be provided in the base panels 114 and 116 (one being shown) for selectively venting the cavities defined by the tray.

The covering and serving member 112 of this embodiment is substantially similar in the overall configuration to the member 12 of the previous embodiment, and includes a substantially planar central portion 134, and a continuous, depending annular rim portion 136 integrally formed with the central portion. However, in this particular embodiment, annular rim 136 provides a skirt portion that surrounds partitioned tray 110 about its periphery. Also, releasable securement of the covering and serving member 112 to the partitioned tray 110 is effected by the provision of one or more recess-defining projections 140 provided integrally on the covering and serving member 112 and spaced from the periphery thereof. As best illustrated in FIG. 7, recess-defining projection 140 is spaced from the peripheral free edge of depending annular rim 136 by about the width of the rim, whereby the peripheral edge portion of the covering and serving member 112 substantially overlies the associated partitioned tray 110. By this arrangement, the vertical dimension of the assembled packaging arrangement is relatively reduced without detracting from the convenience with which covering and serving member 112 can be used for consumption of the food products packaged in the arrangement. Thus, annular edge flange 122 of the partitioned tray 110 provides a lip which is releasably received within the recess defined by projection 140 whereby the partitioned tray 110 and the covering and serving member 112 can be releasably secured together.

As noted above, it is preferred that the covering and serving member of the present packaging arrangement be formed of so-called "dual ovenable" material, while the partitioned tray of the construction is formed from material which may or may not be suited for use in conventional or microwave ovens. Accordingly, it is contemplated that the combination covering and serving member of the arrangement be formed by known thermoforming techniques from crystallizable polyethylene terephthalate (CPET) material, such as disclosed in U.S. Pat. No. 4,463,121, to Gartland, et al, which desirably exhibits transparency to microwave energy as well as dimensional stability at temperatures up to about 450° F. without excessive brittleness at freezing temperatures. Other materials which may be suitable, depending upon the type of food to be packaged and the desired method of preparation include polycarbonate (PC) and polyetherimide (PEI).

In contrast, the partitioned tray of the arrangement is preferably formed of relatively less expensive material, such as "ovenable" paperboard (polyethylene terephthalate impregnated paperboard), metallic foil such as aluminum.

As will be appreciated, the configuration of the present packaging arrangement promotes its versatile use. Since the food products are initially packaged in the partitioned tray, highly desirable control of spilling, splashing, or other undesired commingling of the products during filling is achieved. Packaging line flexibility is enhanced since a single or "common" partitioned tray may be used in combination with different covering and serving members (such as differently colored serving members, for example), as might be required for packaging foods for different channels of distribution. Of course, economical use is promoted since the partitioned tray of the arrangement (which generally requires a relatively greater quantity of material in view of its upstanding partitions) is formed from material which is less expensive than that from which the covering and serving member is formed.

The foregoing is intended as illustrative but not limiting. Variations and modifications may be effected without departing from the true spirit and scope of the novel concept of the present invention. No limitation with respect to the specific embodiments illustrated herein is intended or should be inferred. The disclosure is intended to cover by the appended claims all such modifications as fall within the scope of the claims.

What is claimed is:

1. An invertible packaging arrangement for preparing and serving a plurality of food products, comprising:

a partitioned tray including substantially planar base means, and sidewall means integral with said base means and extending upwardly therefrom, said partitioned tray further including at least one upstanding, integral partition member extending upwardly from said base means, said partition member being integral with said sidewall means, and extending upwardly from said base means beyond said upstanding sidewall means, said partition member together with said sidewall means and said base means defining a plurality of cavities for respectively receiving food products therein;

a combination covering and serving member sized to be coextensive with said tray and having a central substantially planar portion, and an annular rim portion extending away from said central portion, said central planar portion being substantially planar throughout the extent thereof defined by said annular rim portion; and means for releasably securing said covering and serving member in superposed relationship to said partitioned tray, said partition member extending into said covering and serving member when said covering and serving member is secured to said partitioned tray, said partition member having an uniterrupted upper free edge portion complemental to the interior configuration of said combination covering and serving member defined by said central planar portion and said annular rim portion, said partition member cooperating with said combination covering and serving member to retain said food products in the respective ones of said plural cavities;

whereby the food products in the plural cavities defined by said partitioned tray can be transferred from said cavities onto said covering and serving member by inversion of said packaging arrangement and without separation of said partitioned tray from said covering and serving member.

2. The packaging arrangement in accordance with claim 1, wherein said securing means comprises recess means defined by one of said partitioned tray and said covering and serving member for releasably receiving lip means defined by the other of said partitioned tray and said covering and serving member.

3. The packaging arrangement in accordance with claim 1, wherein the upper extent of each said partition member has a configuration complemental to the interior configuration of said covering and serving member.

4. An invertible packaging arrangement for preparing and serving a plurality of food products, comprising:

a partitioned tray including substantially planar base means, and sidewall means integral with said base means and extending upwardly therefrom, said partitioned tray further including at least one upstanding, integral partition member extending upwardly from said base means, said partition member being integral with said sidewall means, and extending upwardly from said base means beyond said upstanding sidewall means, said partition member together with said sidewall means and said base means defining a plurality of cavities for respectively receiving food products therein:

a combination covering and serving member having a central substantially planar portion, and an annular rim portion extending away from said central portion; and means for releasably securing said covering and serving member in superposed relationship to said partitioned tray, said partition member extending into said covering and serving member when said covering and serving member is secured to said partitioned tray;

whereby the food products in the plural cavities defined by said partitioned tray can be transferred from said cavities onto said covering and serving member by inversion of said packaging arrangement and without separation of said partitioned tray from said covering and serving member, said base means of said partitioned tray comprising a plurality of base panels respectively defining the lower extent of each said cavity of said partitioned tray, each said partition member comprising a pair of adjacent partition walls joined at their upper edges to each other and respectively joined at their lower edges to the base panels of adjacent ones of said cavities to facilitate formation of said partitioned tray from sheet material.

5. The packaging arrangement in accordance with claim 4, wherein each said base panel of said partitioned tray defines means for selectively venting the respective cavity associated therewith.

6. An invertible packaging arrangement for substantially simultaneous preparing and serving of a plurality of food products, comprising:

a partitioned tray including substantially planar base means comprising a plurality of base panels, and sidewall means integral with said base means and extending upwardly therefrom, said partitioned tray further including at least one integral, upstanding partition member extending upwardly from said base means, said partition member being integral with said sidewall means whereby said partitioned tray defines a plurality of cavities for respectively receiving the food products therein, the lower extent of each said cavity being defined by a respective one of said base panels, each said partition member comprising a pair of adjacent partition walls joined at their upper edges to each other and respectively joined at their lower edges to the base panels defining adjacent ones of said cavities, each said partition member extending upwardly from said base means beyond said sidewall means;

a combination covering and serving member having a substantially planar central portion, and an annular rim portion extending away from said central portion; and means for releasably securing said covering and serving member in superposed relation to said partitioned tray comprising recess means defined by one of said partitioned tray and covering and serving member for releasably receiving a lip means defined by the other of said tray and said serving member, each said partition member extending into said covering and serving member when said covering and serving member is secured to said partitioned tray, the upper extent of each said partition member having a configuration complemental to the interior configuration of said covering and serving member, whereby said food products can be placed in the plurality of cavities defined by said partitioned tray and said covering and serving member fitted thereto, with each said partition member cooperating with said covering and serving member for retaining said food products in the respective ones of said cavities, said packaging arrangement being thereafter invertible so that the food products can transfer from said cavities onto said covering and serving member and said partitioned tray can be removed for serving the food products.

7. An invertible packaging arrangement for substantially simultaneous preparing and serving of a plurality of food products, comprising:

a combination covering and serving member having a substantially planar central portion, and an annular rim portion extending away and depending from said central portion; and a partitioned tray sized to substantially nest within said combination covering and serving member and including substantially planar base means comprising a plurality of base panels, and sidewall means integral with said base means, extending upwardly therefrom and terminating in a peripheral lip, said partitioned tray further including at least one integral, upstanding partition member extending upwardly from said base means, said partition member being integral with said sidewall means whereby said partitioned tray defines a plurality of cavities for respectively receiving the food products therein, the lower extend of each said cavity being defined by a respective one of said base panels, each said partition member corprising a pair of adjacent partition walls joined at their upper edges to each other and respectively joined at their lower edges to the base panels defining adjacent ones of said cavities;

including means for releasably securing said covering and serving member in superposed relation to said partitioned tray comprising a recess defined by said covering and serving member for releasably receiving said lip, said recess being spaced inwardly from the periphery of said covering and serving member and extending to the junction between said planar central portion and said annular rim portion of said combination covering and serving member, the vertical extent of said annular rim being substantially equal to the vertical extent of said sidewall means of said partitioned tray, so that partitioned tray fits and nests generally completely within said covering and serving member and the annular rim portion thereof substantially overlies and surrounds said partitioned tray, whereby said food products can be placed in the plurality of cavities defined by said partitioned tray and said covering and serving member fitted thereto, said packaging arrangement being thereafter invertible so that the food products can transfer from said cavities onto said covering and serving member and said partitioned tray can be removed for serving the food products.

* * * * *